US010294751B2

(12) United States Patent
Jones et al.

(10) Patent No.: US 10,294,751 B2
(45) Date of Patent: May 21, 2019

(54) BALANCE LINE CONTROL SYSTEM WITH RESET FEATURE FOR FLOATING PISTON

(71) Applicant: BAKER HUGHES, A GE COMPANY, LLC, Houston, TX (US)

(72) Inventors: Brett C. Jones, Broken Arrow, OK (US); John E. Burris, Bixby, OK (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 66 days.

(21) Appl. No.: 15/070,196

(22) Filed: Mar. 15, 2016

(65) Prior Publication Data

US 2017/0268314 A1 Sep. 21, 2017

(51) Int. Cl.
*E21B 34/10* (2006.01)
*E21B 34/16* (2006.01)

(52) U.S. Cl.
CPC ..... *E21B 34/101* (2013.01); *E21B 34/16* (2013.01)

(58) Field of Classification Search
CPC ..... E21B 34/16; E21B 34/101
See application file for complete search history.

(56) References Cited

U.S. PATENT DOCUMENTS 5,906,220 A * 5/1999 Thompson ..... E21B 34/10 137/488
7,743,833 B2 6/2010 Casciaro et al.
8,534,317 B2 9/2013 Plunkett et al.
2003/0168219 A1 9/2003 Sloan
2008/0314599 A1 12/2008 Bane et al.
2012/0073829 A1* 3/2012 Smith ..... E21B 34/10 166/375
2013/0056222 A1 3/2013 Smith et al.

FOREIGN PATENT DOCUMENTS

EP 0915230 A2 5/1999
EP 2434090 A2 3/2012
WO 2015084529 A1 6/2015

* cited by examiner

*Primary Examiner* — Nicole Coy
*Assistant Examiner* — Yanick A Akaragwe
(74) *Attorney, Agent, or Firm* — Shawn Hunter

(57) ABSTRACT

An operating control line is in communication with an operating piston for the safety valve as well as an equalizing piston such that pressure in the operating control line opens the safety valve and holds the equalizer valve closed. A balance chamber receives fluid from an operating piston in the safety valve when the valve opens to displace a floating piston to the open position. Operating control line pressure reduction allows valve closure and opposite floating piston movement to the closed position. If the floating piston is forced by a tubing seal leak against the open position travel stop, pressure in a balance control line against the equalizing valve member moves it from a seat to then equalize pressure on opposed ends of the floating piston allowing a bias force to move the floating piston off the open position stop so the safety valve can open despite the tubing leak.

17 Claims, 3 Drawing Sheets

BALANCE LINE CONTROL SYSTEM WITH RESET FEATURE FOR FLOATING PISTON

FIELD OF THE INVENTION

The field of the invention is hydraulic control systems for borehole tools and more particularly systems that employ a control line and a balance line to the surface with a floating piston isolating a balance chamber. In the event leakage of tubing pressure prevents downward movement of the floating piston on safety valve closure, a pressure equalization enabled by applied pressure on the balance line allows reset of the floating piston to allow continued operation of the safety valve despite the tubing pressure leak.

BACKGROUND OF THE INVENTION

Subsurface safety valves are typically hydraulically controlled from a remote location using one or two control lines. An advantage of a two control line system is that hydrostatic pressure in each line is canceled out so that a closure spring for a flow tube does not need to resist hydrostatic pressure as is the case with single control line systems. In two line control systems pressure on top of an operating piston moves a flow tube against a flapper to open the valve. Removal of such pressure from the main control line allows a closure spring to reverse movement of the flow tube to allow the flapper to rotate 90 degrees to closed position of the safety valve. In the past operators have wanted or regulations required a barrier in the second or balance control line so that if tubing pressure leaks into the hydraulic system there would be a barrier to keep hydrocarbons from reaching a surface location through the balance line.

The floating piston in the balance line served this purpose as a barrier. In normal valve operations pressure applied in the main control line to the top of a piston whose movement shifted the flow tube would result in hydraulic fluid displacement to the underside of the floating piston. Conversely, as pressure was removed from the main control line and the closure spring pushed up the flow tube hydraulic fluid would be drawn into the safety valve from under the floating piston to enable the safety valve to close. The floating piston would just move up when the safety valve open and reverse its motion when the safety valve closed, each time displacing an equal volume of hydraulic fluid as movement of the operating piston had displaced. The floating piston was sometimes biased toward the down position to put it in the ready position for safety valve opening.

Sometimes, seals could leak in such safety valve hydraulic systems such that the much higher tubing pressure could leak into the balance control line and against the underside of the floating piston. This could happen slowly taking months or even years to reach an extreme condition where the floating piston would be up against an upper travel stop with tubing pressure under it. As a result the safety would not be functional to open since the operating piston in the safety valve could not displace hydraulic fluid because the floating piston could not move because it was forced against an upward travel stop due to tubing pressure leaking past a seal. When this happened in the past the safety valve would need to be removed, which caused very expensive downtime.

The present invention is a reconfiguration of the two control line system that incorporates the floating piston working normally the same way as it worked in the past. What is different is the addition of an operable one way valve that can be opened with pressure applied to the balance line such that when such equalizing valve was forced open from the balance line applied pressure, the pressure on opposed sides of the floating piston could equalize and the position of the floating piston could change. The floating piston, now placed in pressure balance on its opposed ends could be biased away from its upper travel stop. Doing this would again make the safety valve operable to open as the hydraulic system would no longer be liquid locked by virtue of the floating piston sitting against its upper travel stop under tubing pressure. In essence the balance line pressure would be raised to the level of the tubing pressure or less depending on seal geometries to get the equalizer valve to open to allow a return spring acting on the floating piston to bias it back to a lower travel stop to allow reopening of the valve without well shutdown and safety valve removal. Many times the seal leakage is so slow that the ability to reposition the floating piston can allow many more years of service for the safety valve. These and other aspects of the present invention will be more readily apparent to those skilled in the art from a review of the description of the preferred embodiment and the associated drawings while recognizing that the full scope of the invention is to be determined from the appended claims. The following references are illustrative of control systems used in the past for safety valves in a borehole application: U.S. Pat. Nos. 5,906,220; 7,743,833; 8,534,317 and US 2008/0314599.

SUMMARY OF THE INVENTION

An operating control line is in communication with an operating piston for the safety valve as well as an equalizing piston such that pressure in the operating control line opens the safety valve and holds the equalizer valve closed. A balance chamber receives fluid from an operating piston in the safety valve when the valve opens to displace a floating piston to the open position. Operating control line pressure reduction allows valve closure and opposite floating piston movement to the closed position. If the floating piston is forced by a tubing seal leak against the open position travel stop, pressure in a balance control line against the equalizing valve member moves it from a seat to then equalize pressure on opposed ends of the floating piston allowing a bias force to move the floating piston off the open position stop so the safety valve can open despite the tubing leak.

DETAILED DESCRIPTION OF THE PREFERRED EMBODIMENT

Figure 1:
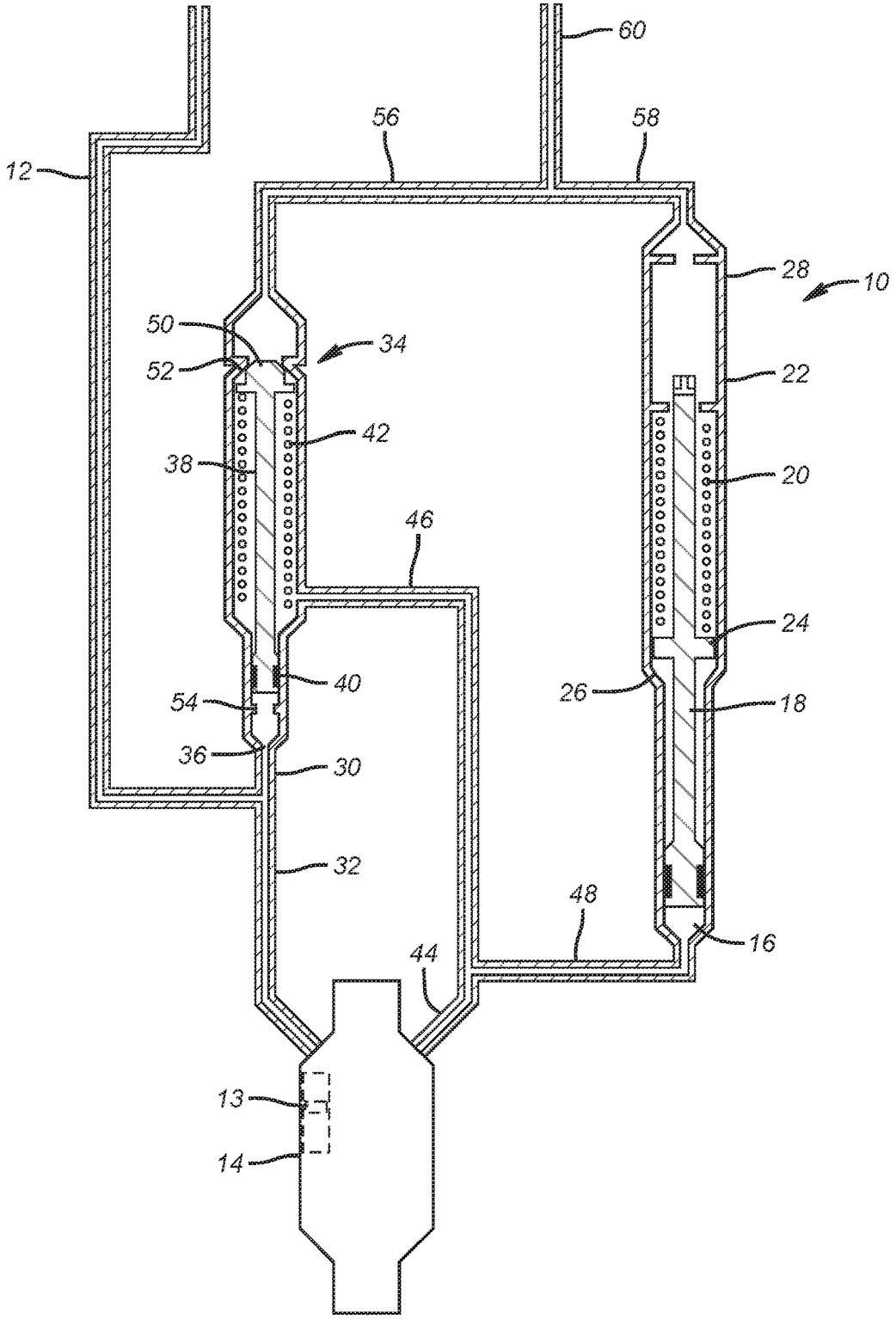
FIG. 1 is a schematic of the present invention showing the safety valve closed or pressure reduced in the balance chamber.

Referring to FIG. 1, the normal operation of the control system 10 will be described. An operating control line 12 extends from a remote location to a subsurface safety valve 14 located in a borehole or conduits associated with a borehole that are not shown. The safety valve 14 is a type well known in the art and generally has a hydraulic piston moving a flow tube to rotate a flapper to open the valve when pressure is applied to the operating control line 12. When pressure is removed from operating control line 12 a closure spring is able to push the flow tube away from the flapper to let the flapper rotate 90 degrees to a closed position against a flapper seat. Moving the flow tube requires delivery of hydraulic fluid against an operating piston 13 in the safety valve 14. Movement of such a piston displaces fluid out of the safety valve body to a balance chamber 16 that is directly below the floating piston 18. Floating piston 18 is biased by spring 20 pushing from support 22 against shoulder 24 on the floating piston 18. Taper 26 represents a lower travel stop for the floating piston 18. Support 22 surrounds the floating piston 18 and guides its movement up to upper stop 28. The piston 18 does not necessarily have to reach the stop 28 as its upper movement can be limited by fully compressing spring 20 between shoulder 24 and support 22 or limited by maximum fluid displacement from valve 14.

Operating control line 12 branches into lines 30 and 32. Line 32 goes to the top of the operating piston inside the safety valve 14 and line 30 goes to the underside of equalizing valve 34 at inlet 36 below the valve member 38 that has a seal 40 to hold the pressure in the operating control line 12. Coming out of the safety valve 14 from below the operating piston of the safety valve 14 is line 44 that branches into lines 46 and 48. Line 46 goes into an annular space where spring 42 is located. Spring 42 pushes up on valve member 38 to hold head 50 against seat 52. Pressure in line 46 acts below head 50 also acts in the same direction as spring 42. Note that the seal area at seat 52 is larger than the seal 40 so that pressure in line 46 creates a net force on head 50 against seat 52. Stop 54 limits the movement of head 50 away from seat 52. Lines 56 and 58 join to become the balance line 60 that goes to a remote surface location. As previously stated the purpose of line 60 is to offset the hydrostatic pressure in operating control line 12 but it has another purpose as will be described.

Figure 2:
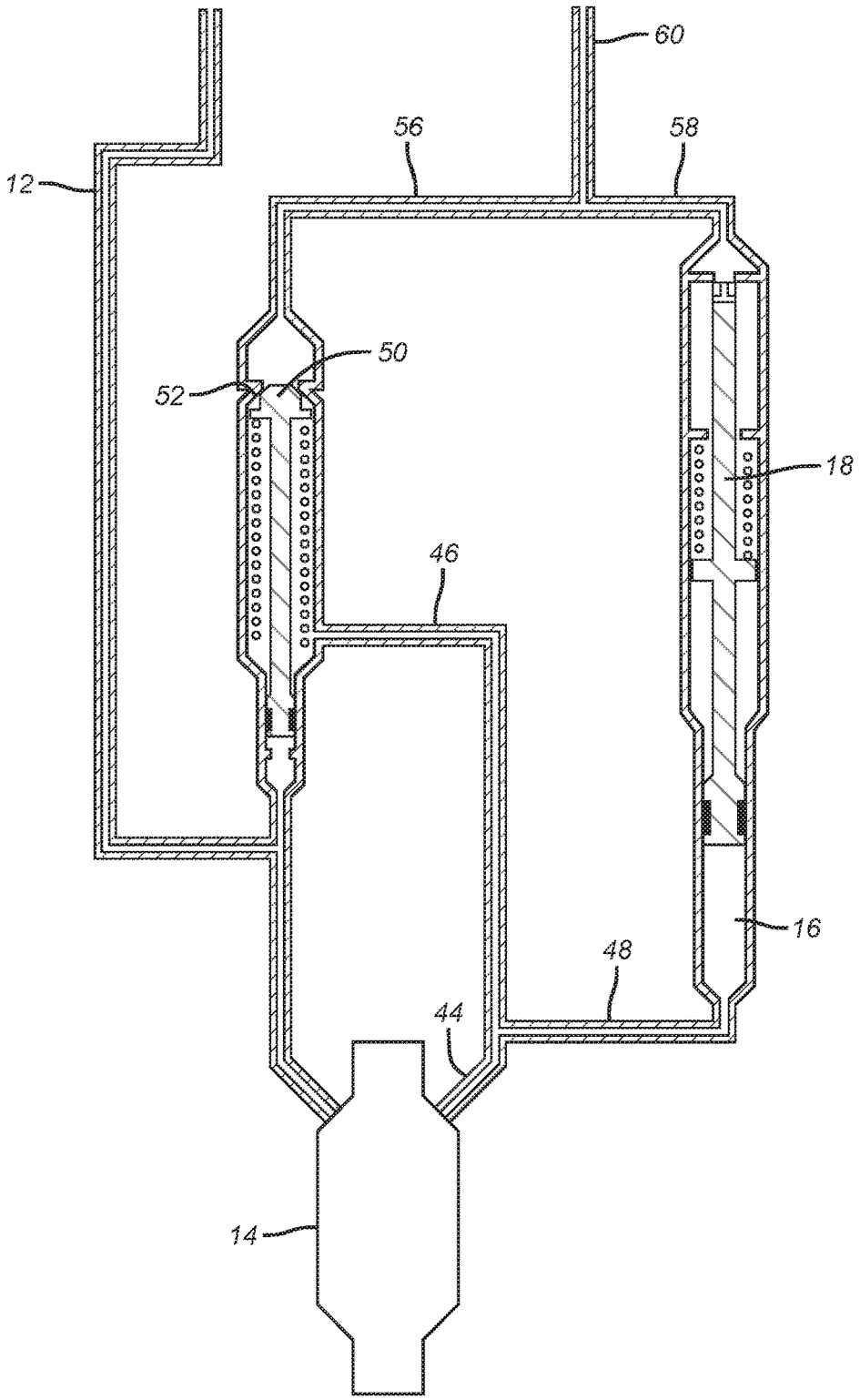
FIG. 2 is the view of FIG. 1 with the safety valve open or the balance chamber gaining pressure.

Valve member 38 does not move during normal operation of the safety valve 14. Floating piston 18 is in a lower position shown in FIG. 1 when the safety valve 14 is closed. To open the safety valve 14 the pressure in operating control line is raised. This opens the safety valve as described above and displaces hydraulic fluid into lines 44 and 48 causing the floating piston 18 to move up as shown in FIG. 2. Note that the volume of chamber 16 has increased in FIG. 2 as compared to FIG. 1. When this happens there is no flow in line 46 because the head 50 is against seat 52. Upward movement of the floating piston 18 displaces fluid into lines 58 and 60. There is no flow in line 56 as the path of least resistance is into the balance line 60. This is because when the pressure is raised in operating control line 12 it is also applied at 36 to push up on the equalizing valve member 38 and displaced fluid from valve 14 through lines 44 and 46 adds to the force to hold the head 50 against the seat 52.

As FIG. 1 shows the floating piston 18 needs to be in the down position so that the valve 14 can go from closed as shown in FIG. 1 to open as shown in FIG. 2. This is because the movement of the operating piston in the valve 14 displaces hydraulic fluid into lines 44 and 48 in response to raised pressure in line 12 that is used to open the valve 14. If for any reason the floating piston 18 is in the FIG. 2 position when the valve 14 is trying to open, then the valve 14 will be liquid locked as the floating piston 18 cannot be displaced toward stop 28 because it is already there. One way this situation can happen is when tubing pressure inside valve 14 from the tubing string that is not shown and to which it is connected finds a leak path around a seal for the hydraulic system. The tubing pressure can often times be substantially higher than the operating hydraulic pressure. The hydraulic pressure at valve 14 typically reflects the hydrostatic at the location of valve 14 and the pressure needed to overcome seal friction and the force of the closure spring when the valve is in the open position. Tubing pressure can be significantly higher. Since the seals in the valve 14 hydraulic system are fairly small it is possible that leakage around such seals can be at such a slow rate that it could take months or even years to get the floating piston 18 displaced to the FIG. 2 position with such leaked tubing pressure such that the valve 14 can only be closed if it was open but cannot thereafter be reopened.

Figure 3:
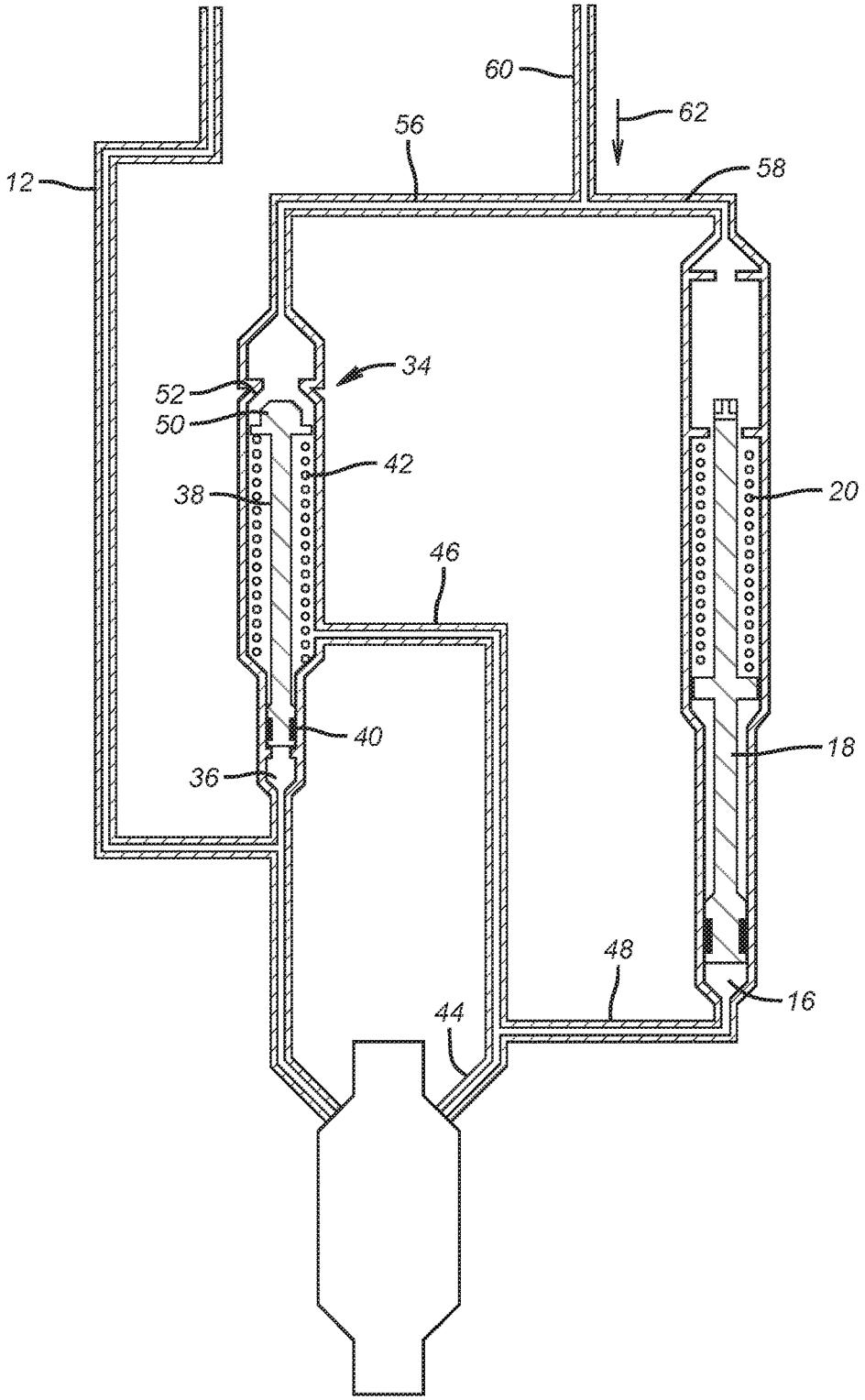
FIG. 3 shows pressure applied into the balance line opening the equalizing valve and allowing the bias on the floating piston to reposition the floating piston such that the safety valve can be opened.

FIG. 3 illustrates a workaround for this situation while still providing a seal in the balance line 60 against hydrocarbons getting to a surface location and the dangers that can ensue if that happens. Thus, when raising pressure at operating control line 12 fails to open the valve 14 because the floating piston 18 is forced by leaking tubing pressure into line 48 and balance chamber 16, the pressure in operating control line 12 is turned off. Instead the pressure is applied in the balance line 60 in the direction of arrow 62. It should be noted that during normal operation no pressure is applied to balance line 60. However, when valve 14 refuses to open with pressure in operating control line 12, then the extraordinary measure of pressurizing balance line 60 in the direction of arrow 62 needs to be implemented.

The pressure under the equalizing valve 34 at inlet 36 is at this time equal to the hydrostatic pressure in operating control line 12 because no pressure is being applied to operating control line 12. This pressure tends to push the valve member 38 and the head 50 toward seat 52. Opposing this force is the pressure in balance line 60 communicating with head 50 through line 56. Since the area of the head 50 is larger than seal there is a net force developed in the direction of moving the head 50 away from seat 52. As the pressure in balance line 60 in the direction of arrow 62 increases so does the net force on the valve member 38 until the force of spring 42 is overcome and the FIG. 3 position for the valve member 38 is assumed. When this happens, the pressure in lines 60, 58 and 56 equalizes with lines 46 and 48 with the result that there is no longer a net force acting on the floating piston 18 so that spring 20 can move the floating piston 18 from the FIG. 2 to the FIG. 3 position. After that happens the valve 14 will no longer be liquid locked in the hydraulic system and the operating piston inside the valve 14 can once again move to allow the valve 14 to open. Removal of pressure in balance line 60 will then allow spring 42 to move head 50 back to seat 52 and, if the tubing pressure leak is small enough, the valve 14 can be operated normally for some time until enough leakage reoccurs to again pin the floating piston 18 in the FIG. 2 position so that the valve 14 again fails to open. The above described procedure can then be repeated in the hope of getting some additional service life for valve 14 without having to pull it out of the hole. In essence the equalizer valve 34 is a bypass passage around the floating piston 18 that can be selectively opened from a remote location by pressurizing balance line 60 in the direction of arrow 62 that opens the equalizer valve 34 to allow the spring 20 to then reposition the floating piston 18 to give it room to move up from the FIG. 3 position to facilitate another opening of the valve 14 for further production.

If the balance chamber 16 loses pressure/volume, the floating piston 18 will move to compensate for that volume loss. If the floating piston reaches its downward stop 26, it will not be able to compensate for any additional fluid loss from the balance chamber 16. If the balance chamber continues to lose pressure, a pressure differential will be created across the equalizer piston 38 causing an opening force on the equalizing piston 38. This opening force is created by hydrostatic pressures from the balance line 60 and control line 12 acting on the area differential between the larger seal on the head 50 of the equalizing piston 38 and the smaller seal 40 on the equalizing piston 38. These pressures are normally counter-acted by the pressure of the balance chamber 16 in the annular area around the equalizing piston 38 but differential pressures are formed across the head 50 and seal 40 of the equalizing piston 38 when pressure decreases in the balance chamber 16. When the balance chamber 16 has lost sufficient pressure to create a sufficient pressure differential to overcome the closing force of the equalizing spring 42 the equalizing piston will shift open and pressure/volume from line 60 will travel through line 56 and refill the lost pressure/volume from the balance chamber 16.

Those skilled in the art will appreciate that the equalizer valve 34 is piped up to be in parallel with the end connections on the floating piston 18 such that its opening, however achieved, puts the floating piston in pressure balance in the balance line 60. At that point the bias of spring 20 repositions the floating piston 18 closer to valve 14 as shown in FIG. 3 so that valve 14 can move to the open position because its operating piston can displace fluid by again moving balance piston 18 against the bias of spring 20. Connecting the operating control line 12 to under the equalizer piston 38 helps insure contact of head 50 on seat 52 during normal operations. Any applied pressure in operating control line 12 is removed prior to trying to open the equalizer valve 34 using pressure in balance line 60 in the direction of arrow 62. It should be noted that line 44 is part of the balance line 60 with lines 56 and 46 forming one parallel branch for the equalizer valve 34 and lines 48 and 58 providing a parallel branch for the floating piston 18.

The above description is illustrative of the preferred embodiment and many modifications may be made by those skilled in the art without departing from the invention whose scope is to be determined from the literal and equivalent scope of the claims below.

We claim:

1. A borehole hydraulically operated valve mounted to a tubular string and actuated by an operating piston operatively connected to a hydraulic control system and connected to a flow tube for tandem movement therewith for moving said flow tube between an open and a closed position for the hydraulically operated valve, the improvement in said hydraulic control system comprising:

an operating control line directly communicating to one side of said operating piston;

a branching balance line communicating to an opposing side of said operating piston in a first branch through a floating piston therein;

a selectively opened equalizer valve connected in parallel to said floating piston in a second branch to enable repositioning of said floating piston with applied pressure in said balance line and with no pressure applied in said operating control line with the floating piston in a position to put said operating piston in liquid lock, whereupon repositioning of said floating piston with pressure applied in said balance line said borehole hydraulically operated valve can be opened due to said repositioning; and a floating piston biasing member acting to push said floating piston toward a position assumed when said borehole hydraulically operated valve is closed.

2. The hydraulic control system of claim 1, wherein:

said equalizer valve is connected to said operating control line.

3. The hydraulic control system of claim 1, wherein:

said equalizer valve is connected to said operating control line.

4. The hydraulic control system of claim 3, wherein:

said equalizer valve comprising an equalizer piston having a head selectively engageable with a seat.

5. The hydraulic control system of claim 4, wherein:

said equalizer piston having a seal smaller than said head when engaged to said seat.

6. The hydraulic control system of claim 4, wherein:

said operating control line in fluid communication with said seal on said equalizer piston to create a force on said head against said seat.

7. The hydraulic control system of claim 6, further comprising:

an equalizer biasing member acting to force said head against said seat.

8. The hydraulic control system of claim 4, further comprising:

a floating piston biasing member acting to push said floating piston toward a position assumed when said borehole hydraulically operated valve is closed.

9. The hydraulic control system of claim 8, further comprising:

at least one seal in said floating piston.

10. The hydraulic control system of claim 3, wherein:

said equalizer valve connected to said operating control line.

11. The hydraulic control system of claim 3, wherein:

said equalizer valve opens from loss of pressure between said floating piston and said borehole hydraulically operated valve.

12. The hydraulic control system of claim 1, wherein:

said equalizer valve comprising an equalizer piston having a head selectively engageable with a seat.

13. The hydraulic control system of claim 12, wherein:

said equalizer piston having a seal smaller than said head when engaged to said seat.

14. The hydraulic control system of claim 12, wherein:

said operating control line in fluid communication with said seal on said equalizer piston to create a force on said head against said seat.

15. The hydraulic control system of claim 14, further comprising:

an equalizer biasing member acting to force said head against said seat.

16. The hydraulic control system of claim 1, further comprising:

at least one seal on said floating piston.

17. The hydraulic control system of claim 1, wherein:

said selectively opened equalizer valve selectively in pressure communication with said floating piston and said borehole hydraulically operated valve when pressure loss occurs therebetween.

* * * * *